US007416278B2

(12) United States Patent
Baker et al.

(10) Patent No.: US 7,416,278 B2
(45) Date of Patent: Aug. 26, 2008

(54) PRINTHEADS AND SYSTEMS USING PRINTHEADS

(75) Inventors: Richard Baker, West Lebanon, NH (US); Robert G. Palifka, Orford, NH (US); Edward R. Moynihan, Plainfield, NH (US); Norma Taber, Enfield, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

(21) Appl. No.: 11/292,572

(22) Filed: Dec. 2, 2005

(65) Prior Publication Data

US 2006/0132540 A1 Jun. 22, 2006

Related U.S. Application Data

(60) Provisional application No. 60/632,802, filed on Dec. 3, 2004.

(51) Int. Cl.
*B41J 2/14* (2006.01)
*B41J 2/16* (2006.01)

(52) U.S. Cl. ..... 347/49; 347/50

(58) Field of Classification Search ..... 347/12, 347/13, 20, 40, 42, 44, 47, 49–50, 84–87
See application file for complete search history.

(56) References Cited

U.S. PATENT DOCUMENTS

| | | | | |
|---|---|---|---|---|
| 4,390,883 | A * | 6/1983 | Stoneburner | 347/84 |
| 4,908,638 | A * | 3/1990 | Albosta et al. | 347/43 |
| 4,940,998 | A * | 7/1990 | Asakawa | 347/50 |
| 6,457,811 | B1 * | 10/2002 | Pan et al. | 347/50 |
| 6,471,335 | B1 * | 10/2002 | Gelbart | 347/49 |

FOREIGN PATENT DOCUMENTS

| | | |
|---|---|---|
| EP | 1 827 835 | 9/2007 |
| KR | 2007-0086908 | 8/2007 |
| WO | WO06/060791 | 6/2006 |

OTHER PUBLICATIONS

Engineering drawing of the Orion printhead (Package Part No. 04208) manufactured by FUJIFILM Dimatix, Inc., offered for sale in the U.S. in 2003.

* cited by examiner

*Primary Examiner*—Juanita D. Stephens
(74) *Attorney, Agent, or Firm*—Fish & Richardson P.C.

(57) ABSTRACT

In general, in one aspect, the invention features an apparatus, including a jetting assembly that has a plurality of nozzles capable of ejecting droplets, a frame configured to position the jetting assembly within the apparatus, and an element that forms a seal between the frame and the jetting assembly.

27 Claims, 3 Drawing Sheets

PRINTHEADS AND SYSTEMS USING PRINTHEADS

CROSS-REFERENCE TO RELATED APPLICATIONS

Under 35 U.S.C. §119(e)(1), this application claims benefit of Provisional Patent Application No. 60/632,802, entitled "PRINTHEADS AND SYSTEMS USING PRINTHEADS," filed on Dec. 3, 2004, the entire contents of which are incorporated herein by reference.

TECHNICAL FIELD

This invention relates to printheads and systems using printheads.

BACKGROUND

Ink jet printers typically include an ink path from an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electro statically deflected element. A typical printhead includes a reservoir and a jetting assembly. The jetting assembly has an array of ink paths with corresponding nozzle openings and associated actuators, and drop ejection from each nozzle opening can be independently controlled. In a drop-on-demand printhead, each actuator is fired to selectively eject a drop at a specific pixel location of an image as the jetting assembly and a printing substrate are moved relative to one another. In high performance jetting assemblies, the nozzle openings typically have a diameter of 50 microns or less, e.g., around 25 microns, are separated at a pitch of 100-300 nozzles/inch, have a resolution of 100 to 3000 dpi or more, and provide drop sizes of about 1 to 70 picoliters (pl) or less. Drop ejection frequency is typically 10 kHz or more.

Hoisington et al. U.S. Pat. No. 5,265,315, the entire contents of which is hereby incorporated by reference, describes a jetting assembly having a semiconductor body and a piezoelectric actuator. The assembly body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path.

Further examples of jetting assemblies are disclosed in U.S. patent application Ser. No. 10/189,947, entitled "PRINTHEAD," to Andreas Bibl et al., filed on Jul. 3, 2002, the entire contents of which are hereby incorporated by reference.

The amount of bending that a piezoelectric material exhibits for a given voltage is inversely proportional to the thickness of the material. As a result, as the thickness of the piezoelectric layer increases, the voltage requirement increases. To limit the voltage requirement for a given drop size, the deflecting wall area of the piezoelectric material may be increased. The large piezoelectric wall area may also require a correspondingly large pumping chamber, which can complicate design aspects such as maintenance of small orifice spacing for high-resolution printing.

In general, printheads can include one or more jetting assemblies. Printing systems can print in a single pass of the substrate relative to the printhead, or in multiple passes. Printheads can be used to jet inks and/or other fluids, such as materials used for electronic components (e.g., electrically conductive materials) or color filter materials for flat panel displays, for example.

SUMMARY

Printheads can be used in a variety of production environments. Various applications can place certain requirements on characteristics of printheads. For example, when printing on edible substrates, printheads should comply with regulatory standards, such as requirements promulgated by the Food and Drug Administration General Manufacturing Practice for food grade or pharmaceutical grade equipment. One such requirement is that a user should be able to clean various printhead surfaces using, e.g., a caustic agent and/or an antibacterial solution. In such applications, it can be desirable to have a printhead whose surfaces can be easily cleaned in order to comply with these requirements and avoid significant downtime of the equipment.

In certain aspects, the invention features a printhead or printhead cluster having a surface that faces the substrate during operation, and that surface can be readily cleaned without excessive downtime of the printhead cluster. Each jetting assembly in the printhead cluster can include an element that forms a seal between the jetting assembly and the frame of the cluster. The seals reduce (e.g., eliminate) leakage of any cleaning agent from the face into the body of the printhead cluster. Such leakage might otherwise cause damage to components (e.g., electronic components) of the printhead cluster. Moreover, in certain embodiments, jetting assemblies in the printhead cluster can be readily removed and replaced without causing excessive downtime.

In general, in one aspect, the invention features printhead clusters that include a frame having a plurality of openings, a plurality of jetting assemblies, each jetting assembly being positioned in one of the openings, and a plurality seal elements, each seal element being arranged to seal a space between a jetting assembly and the frame.

Embodiments of the printhead clusters can include one or more of the following features and/or features of other aspects. For example, the frame can be a portion of an enclosure housing the jetting assemblies and a surface of the frame forms a face of the enclosure. The seal elements can substantially prevent fluid from entering the enclosure when the face of the enclosure is exposed to the fluid. The enclosure can house at least one reservoir for storing a fluid and during operation the jetting assemblies deposit droplets of the fluid onto a substrate. The fluid can be an ink. The seal elements can be o-rings. The seal elements can be formed from rubber.

In general, in another aspect, the invention features apparatus that include a jetting assembly having a plurality of nozzles capable of ejecting droplets, a frame configured to position the jetting assembly within the apparatus, and an element that forms a seal between the frame and the jetting assembly.

Embodiments of the apparatus can include one or more of the following features and/or features of other aspects. For example, the nozzles can be arranged in a nozzle plate of the jetting assembly, and the nozzle plate is arranged substantially parallel to a surface of the frame. The nozzle plate can be arranged coplanar to the surface of the frame. The element can form a seal between the frame and the jetting assembly by filling a gap between the frame and the jetting assembly. The frame can be configured to position one or more additional jetting assemblies within the apparatus. The frame can include one or more elements to align the jetting assembly relative to the frame. The jetting assembly can include a body and a nozzle plate. The body of the jetting assembly can include a plurality of channels and a piezoelectric actuator, where the channels correspond to nozzles in the nozzle plate and the piezoelectric actuator is configured to cause pressure variations in a fluid in the channels to eject fluid droplets through the nozzles.

In general, in a further aspect, the invention features systems that include a printhead cluster enclosure having a plurality of jetting assemblies each positioned in a corresponding opening in a face of the enclosure, a space between each jetting assembly and the face being substantially sealed, and a conveyor configured to position a substrate relative to the face of the printhead so that during operation the jetting assemblies deposit droplets of a jetting fluid onto the substrate.

Embodiments of the systems can include one or more of the following features and/or features of other aspects. For example, the conveyor can be configured to position a continuous web substrate relative to the face of the printhead cluster. The system can further include a control module configured to control the operation of the jetting assemblies in the printhead cluster enclosure. The system can further include a supply reservoir remote from the printhead enclosure, the supply reservoir being configured to supply a fluid to the jetting assemblies in the printhead cluster enclosure.

Embodiments of the invention can include one or more of the following advantages. Embodiments include printhead clusters that conform to requirements for food grade and/or pharmaceutical grade equipment. The printhead clusters can include multiple jetting assemblies and can present a fully sealed, washable surface to the substrate. Moreover, jetting assemblies can be rapidly installed and aligned, without significant downtime of the printhead cluster. Accordingly, downtime of systems that utilize these printhead clusters due to servicing (e.g., cleaning and or repairing faulty jetting assemblies) can be reduced.

A seal between the jetting assembly and frame can also accommodate different amounts of thermal expansion between the frame and the jetting assembly. The integrity of the seal can be maintained over a range of temperatures (e.g., temperatures normally experienced during operation, maintenance, storage, and/or transportation).

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1:
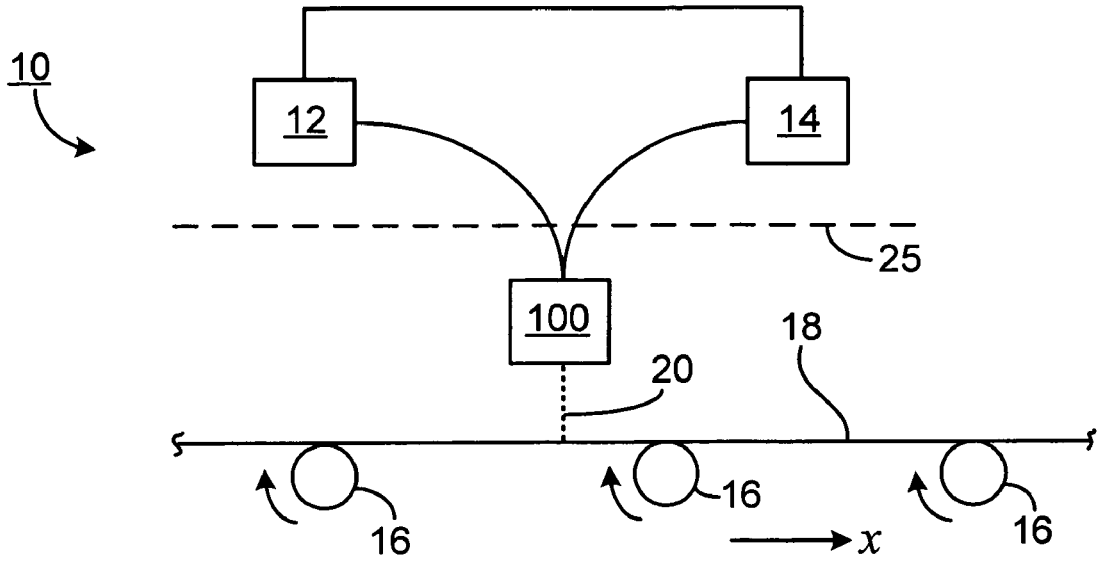
FIG. 1 is a schematic diagram of a printing line that includes a printhead cluster.

FIG. 1 shows a schematic view of a printing line 10 that includes a printhead cluster 100. Printhead cluster 100 is positioned relative to a continuous web substrate 18 so that jetting assemblies in the cluster deposited ink droplets 20 onto the substrate as the substrate moves past the cluster (in the x-direction). Printing line 10 includes rollers 16 that support continuous web substrate 18 and move the substrate past the cluster. Printhead cluster 100 can be sufficiently large so that the jetting assemblies in the cluster span the continuous web substrate.

In some embodiments, printing line 10 can include additional printhead clusters (e.g., two or more printhead clusters, three or more printhead clusters, four or more printhead clusters).

Attached to printhead cluster 100 are a control module 12 and a supply reservoir 14. Control module 12 includes control electronics and a user interface that allows an operator to start, stop, and adjust the operation of printhead cluster 100. Control module 12 also includes electronics that control the timing of droplet ejection from the jetting assemblies to synchronize the jetting with the position of the moving substrate.

Control module 12 is in communication with supply reservoir 14 and coordinates filling of reservoirs in printhead cluster 100 with ink in supply reservoir 14. Electronic components in control module 12 receive signals from ink level sensors in printhead cluster 100 indicating when additional ink is required in the printhead cluster reservoirs. Upon receiving these signals, control module 12 sends a signal to supply reservoir 14 causing a pump in attached to the supply reservoir to pump a volume of ink from the reservoir to printhead cluster 100.

In certain embodiments, a barrier 25 (e.g., a wall) separates the environments in which the control module and/or supply reservoir are kept relative to the rest of printing line 10. For example, when the application demands certain environmental standards at the deposition station, the control module and/or supply reservoirs can be located in different rooms from the printhead cluster and web transport system. This can allow an operator to control the printhead cluster without entering the controlled environment area where the printhead cluster is located. This can also allow an operator to replenish the fluid supply in the supply reservoir without entering the controlled environment area where the printhead cluster is located. Examples of applications that may have particular environmental demands are electronics manufacturing (e.g., requiring a clean room environment, such as a class 1000, 100, or 10 clean room environment) or food product manufacturing (e.g., requiring an environment with low bacterial concentrations and/or low concentrations of other potential food contaminants).

In general, the nature of the continuous web substrate may vary. In some embodiments, the web is a paper web. In certain embodiments, the web can include a polymer (e.g., an extruded or cast polymer web). In embodiments, the web can be formed from a food product (e.g., dough).

Furthermore, while substrate 18 is a continuous web substrate, in some embodiments, the substrate can be in non-continuous form. For example, rather than a continuous web substrate, system 10 can include a platen that supports individual substrate portions and conveys them relative to printhead cluster 100. Examples of non-continuous substrates include sheets of paper or cardboard, sheets of polymer, individual food products (e.g., cookies) or electronic components.

In general, the type of jetting fluid may vary. The jetting fluid may be ink (e.g., UV curable ink, hot melt ink, and/or solvent based ink). In some embodiments, the jetting fluid includes an electrically conductive component (e.g., a solder), an electrically insulating component (e.g., a polymer for use as a dielectric in a microelectronic device), or an optically active component (e.g., a component of an organic light emitting material, or a color filter). Where the substrate is a food product, the jetting fluid may be an edible substance (e.g., an edible ink).

Figure 2A:
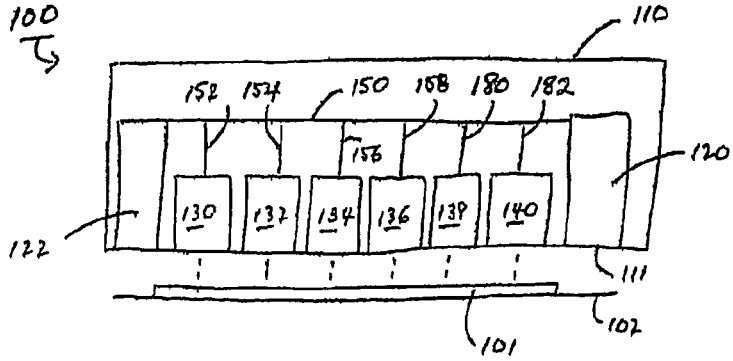
FIG. 2A is a schematic diagram of a printhead cluster.

Referring to FIG 2A, a printhead cluster 100 includes a housing 110 that holds six jetting assemblies 130, 132, 134, 136, 138, and 140 and two reservoirs 120 and 122. Each jetting assembly includes a jetting module (e.g., a piezoelectric ink jet module) that has an array of nozzles in a nozzle plate. The nozzle plate of each jetting assembly is positioned substantially parallel (e.g., substantially coplanar) to the surface of the frame that faces the substrate. Reservoirs 120 and 122 are in fluid communication with each other via tube 150 (e.g., a rubber tube). Jetting assemblies 130, 132, 134, 136, 138, and 140 are in fluid communication with reservoirs 120 and 122 respectively via tubes 152, 154,156, 158, 180, and 182, which connect to tube 150. A conveyor 102 moves a substrate beneath a surface 111 of the printhead cluster. During operation, jetting assemblies 130, 132, 134, 136, 138, and 140 jet fluid droplets onto a substrate 101 as it moves.

Figure 2B:
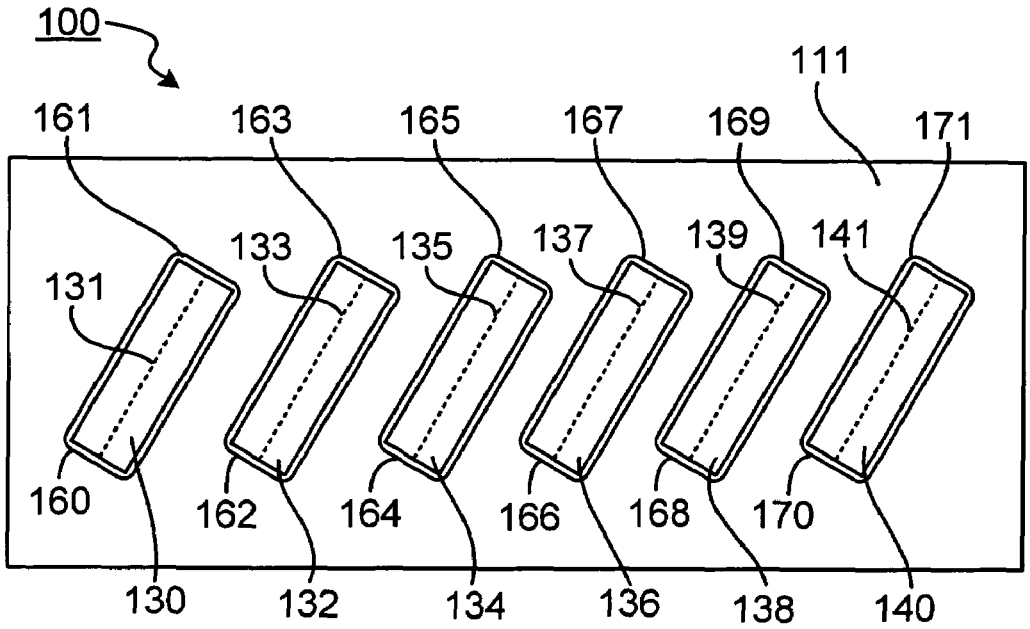
FIG. 2B is a plan view of a surface of the printhead cluster shown in FIG. 2A.

Referring to FIG. 2B, surface 111 of printhead cluster 100 is a portion of a frame that includes a series of openings 160, 162, 164, 166, 168, and 170, in which jetting assemblies 130, 132, 134, 136, 138, and 140 are respectively positioned. The jetting assemblies are positioned so that nozzle arrays 131, 133, 135, 137, 139 and 141 in the respective jetting assemblies' nozzle plates, can eject fluid droplets away from surface 111. There is a gap (gaps 161, 163, 165, 167, 169, and 171, respectively) between each jetting assembly and the edge of the frame. Each gap is sealed by an o-ring gasket.

Figure 3:
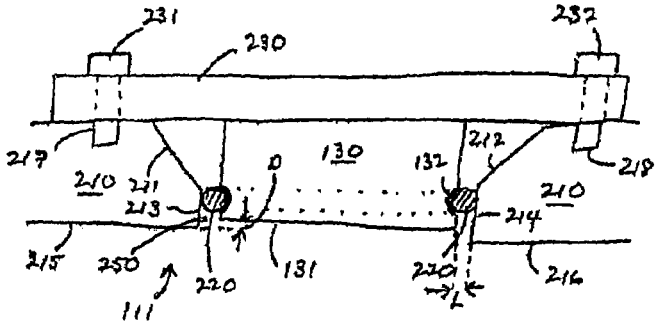
FIG. 3 is a cross-sectional view of a portion of the printhead cluster shown in FIG. 2A.

Referring to FIG. 3, jetting assembly 130 is secured to frame 210 by a mount alignment bar 230 and pins 231 and 232. Pins 231 and 232 mate with holes 217 and 218, respectively, providing precision alignment of jetting assembly 130 with respect to frame 210 and the other jetting assemblies. Examples of frames for holding jetting assemblies with features to align the jetting assemblies to the frame are shown, for example, in U.S. patent application Ser. No. 11/118,704, entitled "DROPLET EJECTION APPARATUS ALIGNMENT," filed on Apr. 29, 2005, and in U.S. patent application Ser. No. 11/118,293, entitled "DROPLET EJECTION APPARATUS ALIGNMENT," also filed on Apr. 29, 2005, the entire contents both of which are incorporated herein by reference.

When secured, jetting assembly 130 is separated from surface 213 and surface 214. In FIG. 3, the amount of separation between jetting assembly 130 and surface 214 is shown as "L." Jetting assembly 130 is similarly separated from surface 213. These separations allow for thermal expansion and/or alignment adjustment of jetting assembly 130 with respect to frame 210. In some embodiments, L is about 0.001 inches (e.g., about 0.005 inches, about 0.01 inches, about 0.02 inches).

As discussed previously, o-ring gasket 220, in contact with jetting assembly 130 and surfaces 213 and 214 of frame 210, creates a seal between the jetting assembly and the frame. The seal prevents fluid on the outside of the housing from leaking into the housing through the space between the jetting assemblies and the frame, e.g., while the face of the frame is being cleaned. O-ring gasket 220 can be a rubber gasket (e.g., silicone rubber or an organic rubber such as Ethylene Propylene Diene Monomer or Terpolymer). Jetting assembly 130 includes a groove 132 that guides the o-ring.

Frame 210 also includes tapered surfaces 211 and 212. Surfaces 211 and 212 guide jetting assembly 130 as it is placed in frame 210. These tapered surfaces allow for easy alignment of the jetting assembly relative to the frame.

Surface 111 includes surfaces 215 and 216 of frame 210, and a nozzle plate surface 131 of jetting assembly 130. Nozzle plate surface 131 is recessed from surface 215 and 216 by an amount "D." By recessing nozzle plate surface from surfaces 215 and 216, the frame surfaces can protect the nozzle plate from, e.g., protrusions or variations in the height of the substrate. In some embodiments, D is about 0.001 inches or more (e.g., about 0.005 inches or more, about 0.01 inches or more, about 0.02 inches or more). Alternatively, in certain embodiments, surface 131 is flush with surfaces 215 and 216.

A small recess 250 exists between frame 210 and jetting assembly 130. In some embodiments, the aspect ratio of recess 250 is sufficiently low so that accumulated fluid in recess 250 can be easily cleaned out, e.g., by spraying with a cleaning fluid and/or wiping. The aspect ratio of recess 250 can be about 1:1 or less (e.g., about 1:2 or less, about 1:3 or less, about 1:4 or less).

Figure 4:
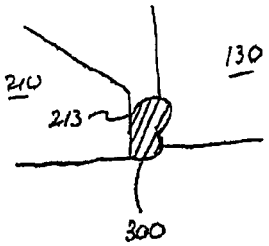
FIG. 4 is a cross-section view of a portion of the printhead cluster including an alternative gasket.

In some embodiments, gasket 220 can be designed so that there is little or no recess between surface 211 and surface 131. Reducing the recess reduces the potential for contaminant accumulation, and can be easier to clean than embodiments where there is a recess in the gap between the surface of the enclosure and the jetting assemblies. For example, referring to FIG. 4, a gasket 300 can have a non-circular cross-section, and can include a portion that fills recess 250. Alternatively, or additionally, gasket 220 can be made from a material that is sufficiently deformable so that it conforms to surface 213 and the surface of jetting assembly 130, and sufficiently large so that it fills recess 250.

A number of embodiments of the invention have been described. Nevertheless, it will be understood that various modifications may be made without departing from the spirit and scope of the invention. Accordingly, other embodiments are within the scope of the following claims.

What is claimed is:

1. A printhead cluster, comprising:

a frame having a plurality of openings;

a plurality of removable jetting assemblies, each jetting assembly being positioned in one of the openings, one or more alignment elements to align the jetting assembly relative to the frame; and a plurality of seal elements, each seal element being arranged to seal a gap between a jetting assembly and the frame, the seal elements substantially prevent fluid from entering the gap between the jetting assembly and the frame when exposed to the fluid.

2. The printhead cluster of claim 1, wherein the frame is a portion of an enclosure housing the jetting assemblies and a surface of the frame forms a face of the enclosure.

3. The printhead cluster of claim 2, wherein the seal elements substantially prevent fluid from entering the enclosure when the face of the enclosure is exposed to the fluid.

4. The printhead cluster of claim 2, wherein the enclosure houses at least one reservoir for storing a jetting fluid and during operation the jetting assemblies deposit droplets of the jetting fluid onto a substrate.

5. The printhead cluster of claim 4, wherein the jetting fluid is an ink.

6. The printhead cluster of claim 1, wherein the seal elements are o-rings.

7. The printhead cluster of claim 1, wherein the seal elements are formed from rubber.

8. The printhead cluster of claim 1, wherein the one or more alignment elements include a mounting bar and pins, the pins securing the mounting bar and the jetting assembly to the frame.

9. The printhead cluster of claim 1, wherein the plurality of jetting assemblies comprising a plurality of nozzle plates that are substantially parallel to a surface of the frame, and the nozzle plates are recessed from the surface of the frame.

10. An apparatus, comprising:

a removable jetting assembly comprising a plurality of nozzles capable of ejecting droplets;

a frame configured to position the jetting assembly within the apparatus, one or more alignment elements to align the jetting assembly relative to the frame; and an element that forms a seal between the frame and the jetting assembly, the seal filling a gap between the frame and the jetting assembly.

11. The apparatus of claim 10, wherein the nozzles are arranged in a nozzle plate of the jetting assembly, and the nozzle plate is arranged substantially parallel to a surface of the frame.

12. The apparatus of claim 11, wherein the nozzle plate is arranged substantially coplanar to the surface of the frame.

13. The apparatus of claim 11, wherein the nozzle plate is recessed from the surface of the frame.

14. The apparatus of claim 10, wherein the frame is configured to position one or more additional jetting assemblies within the apparatus.

15. The apparatus of claim 10, wherein the jetting assembly comprises a body and a nozzle plate.

16. The apparatus of claim 15, wherein the body of the jetting assembly comprises a plurality of channels and a piezoelectric actuator, where the channels correspond to nozzles in the nozzle plate and the piezoelectric actuator is configured to cause pressure variations in a fluid in the channels to eject fluid droplets through the nozzles.

17. The apparatus of claim 10, wherein the one or more alignment elements include a mounting bar and pins, the pins securing the mounting bar and the jetting assembly to the frame.

18. A system, comprising:

a printhead cluster enclosure including a plurality of removable jetting assemblies each positioned in a corresponding opening in a face of the enclosure, a gap between each jetting assembly and the face being substantially sealed, one or more alignment elements to align the jetting assembly relative to the enclosure; and a conveyor configured to position a substrate relative to the face of the printhead so that during operation the jetting assemblies deposit droplets of a jetting fluid onto the substrate.

19. The system of claim 18, wherein the conveyor is configured to position a continuous web substrate relative to the face of the printhead cluster.

20. The system of claim 18, further comprising a control module configured to control the operation of the jetting assemblies in the printhead cluster enclosure.

21. The system of claim 18, further comprising a supply reservoir remote from the printhead enclosure, the supply reservoir being configured to supply a fluid to the jetting assemblies in the printhead cluster enclosure.

22. The system of claim 18, wherein the one or more alignment elements include a mounting bar and pins, the pins securing the mounting bar and the jetting assembly to the enclosure.

23. The system of claim 18, wherein the plurality of jetting assemblies comprising a plurality of nozzle plates that are substantially parallel to a surface of the frame, and the nozzle plates are recessed from the surface of the frame.

24. A printhead cluster, comprising:

a frame having a plurality of openings;

a plurality ofjetting assemblies, each jetting assembly being positioned in one of the openings, one or more alignment elements to align the jetting assembly relative to the frame, wherein the one or more alignment elements include a mounting bar and pins, the pins securing the mounting bar and the jetting assembly to the frame; and a plurality of seal elements, each seal element being arranged to seal a gap between a jetting assembly and the frame, the seal elements substantially prevent fluid from entering the gap between the jetting assembly and the frame when exposed to the fluid.

25. An apparatus, comprising:

a jetting assembly comprising a plurality of nozzles capable of ejecting droplets;

a frame configured to position the jetting assembly within the apparatus, one or more alignment elements to align the jetting assembly relative to the frame, wherein the one or more alignment elements include a mounting bar and pins, the pins securing the mounting bar and the jetting assembly to the frame; and an element that forms a seal between the frame and the jetting assembly, the seal filling a gap between the frame and the jetting assembly.

26. A system, comprising:

a printhead cluster enclosure including a plurality of jetting assemblies each positioned in a corresponding opening in a face of the enclosure, a gap between each jetting assembly and the face being substantially sealed, one or more alignment elements to align the jetting assembly relative to the enclosure, wherein the one or more alignment elements include a mounting bar and pins, the pins securing the mounting bar and the jetting assembly to the frame; and a conveyor configured to position a substrate relative to the face of the printhead so that during operation the jetting assemblies deposit droplets of a jetting fluid onto the substrate.

27. A printhead cluster, comprising:

a frame having a plurality of openings;

a plurality ofjetting assemblies, each jetting assembly being positioned in one of the openings, one or more alignment elements to align the jetting assembly relative to the frame; and a plurality of o-rings, each o-ring being arranged to seal a gap between a jetting assembly and the frame, where the o-rings substantially prevent fluid from entering the gap between the jetting assembly and the frame when exposed to the fluid.

* * * * *

UNITED STATES PATENT AND TRADEMARK OFFICE

CERTIFICATE OF CORRECTION

PATENT NO. : 7,416,278 B2
APPLICATION NO. : 11/292572
DATED : August 26, 2008
INVENTOR(S) : Richard J. Baker et al.

It is certified that error appears in the above-identified patent and that said Letters Patent is hereby corrected as shown below:

In claim 24, line 3, delete “ofjetting” and insert --of jetting--.

In claim 27, line 3, delete “ofjetting” and insert --of jetting--.

Signed and Sealed this

Eleventh Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,416,278 B2
APPLICATION NO. : 11/292572
DATED : August 26, 2008
INVENTOR(S) : Richard J. Baker et al.

It is certified that error appears in the above-identified patent and that said Letters Patent is hereby corrected as shown below:

Column 8, in claim 24, line 11, delete "ofjetting" and insert --of jetting--.

Column 8, in claim 27, line 53, delete "ofjetting" and insert --of jetting--.

This certificate supersedes the Certificate of Correction issued November 11, 2008.

Signed and Sealed this

Ninth Day of December, 2008

JON W. DUDAS
*Director of the United States Patent and Trademark Office*